US010401104B2

(12) United States Patent
Burns et al.

(10) Patent No.: US 10,401,104 B2
(45) **Date of Patent: *Sep. 3, 2019**

(54) MAGAZINE RELEASE BUTTON INTERFERENCE PIN ASSEMBLY AND AR-STYLE LOWER RECEIVER

(71) Applicants: John W Burns, Newcastle, CA (US); Dustin W Burns, Loomis, CA (US)

(72) Inventors: John W Burns, Newcastle, CA (US); Dustin W Burns, Loomis, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/004,637

(22) Filed: Jun. 11, 2018

(65) Prior Publication Data

US 2018/0347927 A1 Dec. 6, 2018

Related U.S. Application Data

(63) Continuation of application No. 15/611,703, filed on Jun. 1, 2017, now Pat. No. 10,001,330.

(51) Int. Cl.

| | |
|---|---|
| ***F41A 9/63*** | (2006.01) |
| ***F41A 17/38*** | (2006.01) |
| ***F41A 3/66*** | (2006.01) |
| ***F41A 9/59*** | (2006.01) |

(52) U.S. Cl.

CPC *F41A 9/63* (2013.01); *F41A 3/66* (2013.01); *F41A 9/59* (2013.01); *F41A 17/38* (2013.01)

(58) Field of Classification Search

CPC ..... F41A 9/63; F41A 9/64; F41A 9/59; F41C 7/11

See application file for complete search history.

(56) References Cited

U.S. PATENT DOCUMENTS

| | | | | |
|---|---|---|---|---|
| 2,478,566 | A * | 8/1949 | Campbell, Jr. | F41A 17/38 42/18 |
| 2,786,293 | A * | 3/1957 | Cook | F41A 17/56 42/70.04 |
| 6,405,471 | B1 * | 6/2002 | Mauch | F41A 19/14 42/66 |
| 10,001,330 | B1 * | 6/2018 | Burns | F41A 17/38 |
| 2018/0128562 | A1 * | 5/2018 | Carsey | F41A 17/38 |

* cited by examiner

*Primary Examiner* — Stephen Johnson

(74) *Attorney, Agent, or Firm* — Craig A. Simmermon

(57) ABSTRACT

Magazine release button interference pin assembly and AR-style lower receiver functions to prevent the depression of the magazine release button on an AR-style rifle while the upper receiver is closed or locked onto the lower receiver. Magazine release button interference pin assembly and AR-style lower receiver prevents magazine release and reloading while the upper receiver is closed or locked onto the lower receiver. Magazine release button interference pin assembly and AR-style lower receiver is a magazine release button interference pin assembly as well as a specially machined lower receiver to accept the magazine release button interference pin assembly. Magazine release button interference pin assembly includes a special magazine release button interference pin with at least two protrusions, a spring, and a retaining pin.

1 Claim, 8 Drawing Sheets

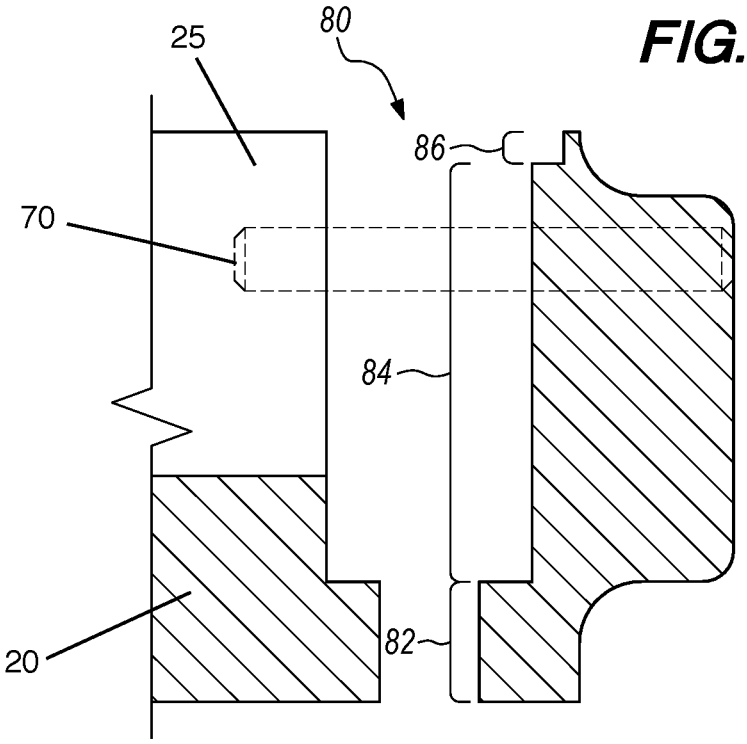
FIG. 12
FIG. 13
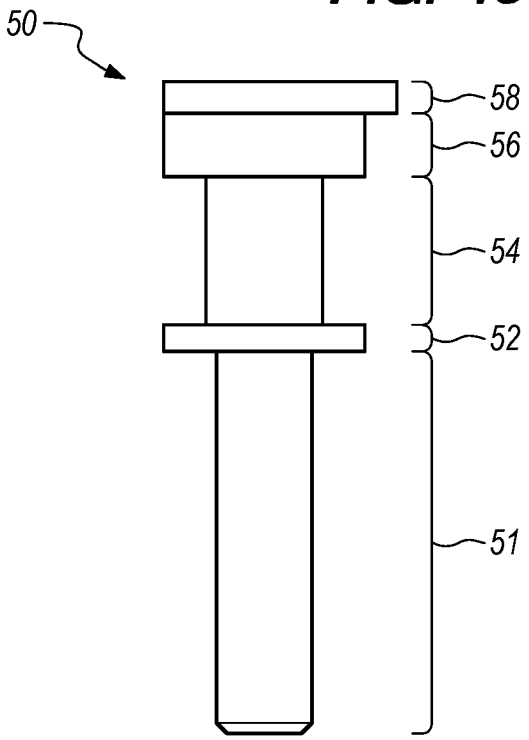

MAGAZINE RELEASE BUTTON INTERFERENCE PIN ASSEMBLY AND AR-STYLE LOWER RECEIVER

CROSS-REFERENCE TO RELATED APPLICATIONS

The instant application is a continuation of U.S. application Ser. No. 15/611,703 entitled "Magazine Release Button Interference Pin Assembly and AR-Style Lower Receiver" filed on Jun. 19, 2018, which is hereby incorporated by reference herein.

BACKGROUND OF THE INVENTION

1. Field of the Invention

This invention pertains to an AR-Style rifle, which comprises an upper receiver assembly and a lower receiver assembly. This invention specifically pertains to the lower receiver assembly, which is the main component of an AR-Style rifle. This invention is a lower receiver of an AR-Style rifle that is machined for and fitted with a special magazine release button interference pin assembly. The special magazine release button interference pin assembly functions to prevent depression of the magazine release button when the upper receiver is closed onto or locked to the lower receiver, thereby preventing the release of the magazine from the rifle and preventing reloading of the rifle when the upper receiver is closed onto or locked to the lower receiver. The upper receiver must be closed or locked to the lower receiver in order to fire an AR-Style rifle because an AR-Style rifle will not fire with the upper receiver opened or pivoted away from the lower receiver. Also, the special magazine release button interference pin assembly functions to allow depression of the magazine release button when the upper receiver is opened, detached, or pivoted away from the lower receiver, thereby allowing release of the magazine from the rifle and reloading of the rifle when the upper receiver is opened, detached, or pivoted away from the lower receiver.

2. Description of Related Art

The AR-Style rifle was first developed in the 1950's by Eugene Stoner and the ArmaLite Company, which was a division of Fairchild Engine and Aircraft Corporation at that time. The AR stands for ArmaLite. ArmaLite developed many rifles with the designation of AR including: AR-5, AR-10, and AR-15. The AR-15 rifle design is the most widely used of the different AR-Style designs. In current times, many different companies manufacture and/or market AR-Style rifles in addition to the ArmaLite Company, which still remains a dominant producer of the AR-Style rifle. The magazine release button interference pin assembly of this invention functions with any AR-Style platform made by any manufacturer.

There are various mechanisms in the prior art that function to disallow depression of the magazine release button or release of the magazine catch on an AR-Style rifle. However, none include a magazine release button interference pin assembly as described here that functions to block depression of the magazine release button and release of the magazine catch when the upper receiver is closed or locked onto the lower receiver where this mechanism on the other hand removes the interference or blockage when the upper receiver is opened, detached, or pivoted away from the lower receiver.

BRIEF SUMMARY OF THE INVENTION

It is an aspect of this invention to provide a magazine release button interference pin that functions to interfere with or otherwise prevent the depression of the magazine release button of an AR-Style rifle when the upper receiver is closed or locked onto the lower receiver of the AR-Style rifle. It is an aspect if this invention to provide a magazine release button interference pin that functions to allow depression of the magazine release button of an AR-Style rifle when the upper receiver is opened or pivoted away from the lower receiver of the AR-Style rifle.

It is an aspect of a magazine release button interference pin to be spring loaded using a spring.

It is an aspect of a magazine release button interference pin to be installed into an interference pin hole machined into the lower receiver.

It is an aspect of a magazine release button interference pin to be locked into the lower receiver with a retaining pin.

It is an aspect of retaining pin to be installed into an retaining pin hole machined into the lower receiver.

BRIEF DESCRIPTION OF THE DRAWINGS

FIG. 5 also defines cross-sectional plane 9-9.

FIG. 6 also defines cross-sectional plane 10-10.

FIG. 12 is an enlarged cross-sectional view of magazine release button interference pin hole in lower receiver that defines the various segments of magazine release button interference pin hole.

FIG. 13 is an enlarged cross-sectional view of magazine release button interference pin that defines the various segments and protrusions of magazine release button interference pin.

DEFINITION LIST

Figure 1:
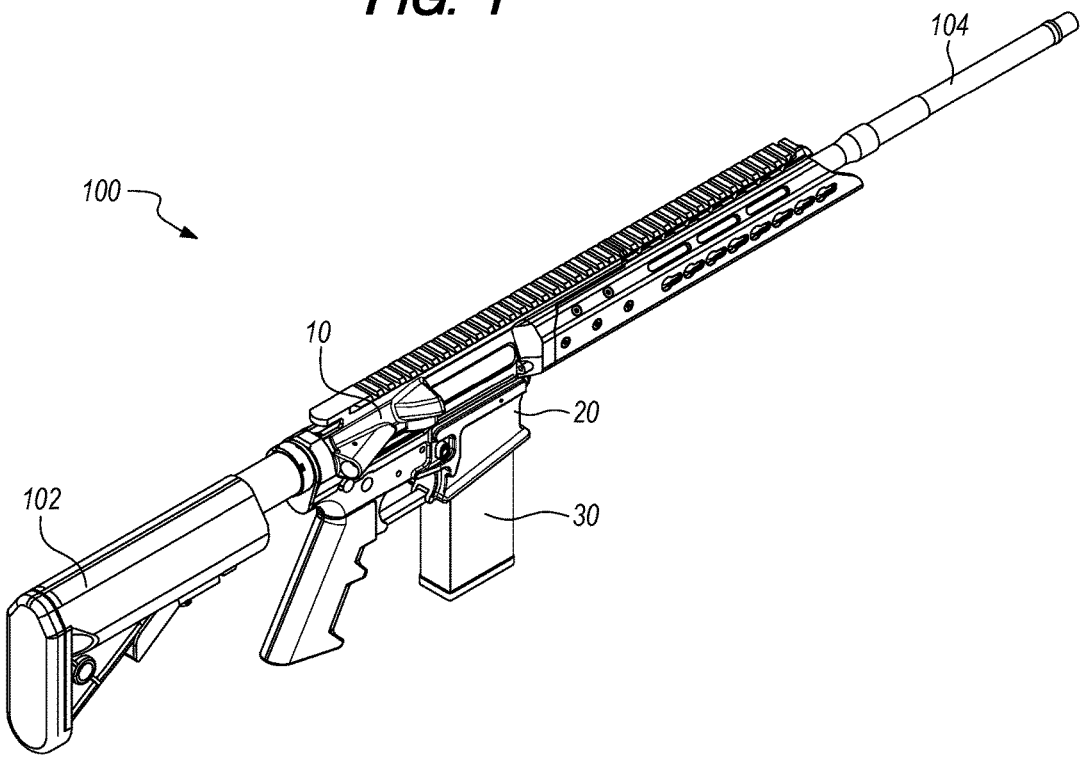
FIG. 1 is a perspective view of an AR-Style rifle.
Figure 2:
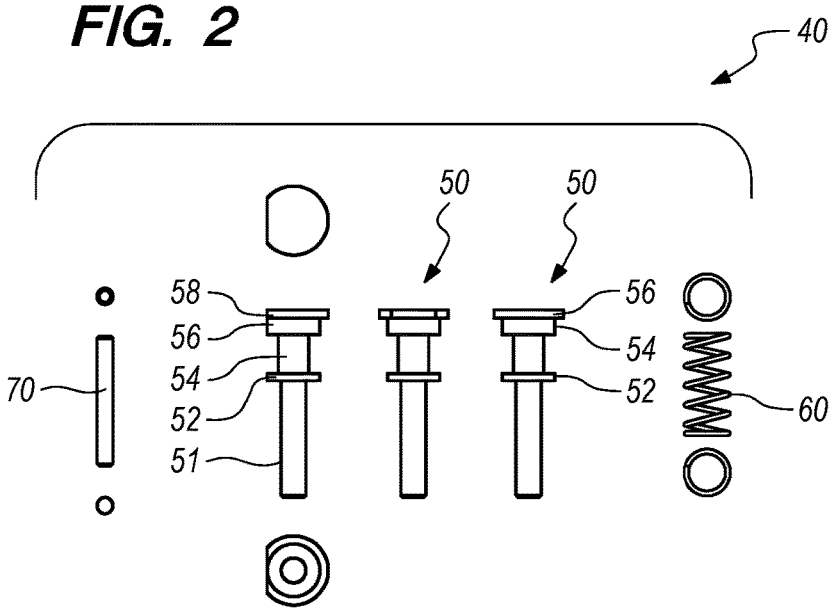
FIG. 2 is a front elevation view, a rear elevation view, a right side elevation view, a left side elevation view, a top plan view, and a bottom plan view of each component in magazine release button interference pin assembly. The front elevation view, rear elevation view, right side elevation view, and left side elevation view of magazine release button interference pin retaining pin are exactly the same. The right side elevation view and left side elevation view of magazine release button interference pin are the same. The front elevation view, rear elevation view, right side elevation view, and left side elevation view of magazine release button interference pin spring are exactly the same.
Figure 3:
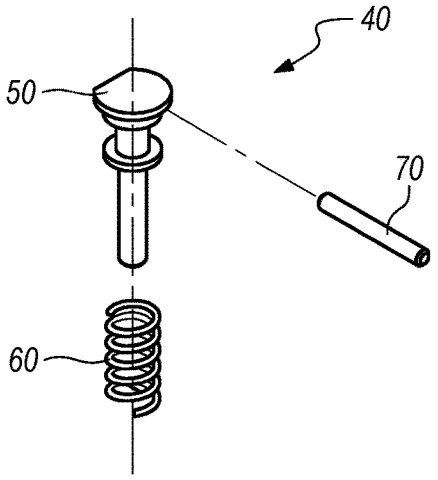
FIG. 3 is an exploded perspective view of magazine release button interference pin assembly.
Figure 4:
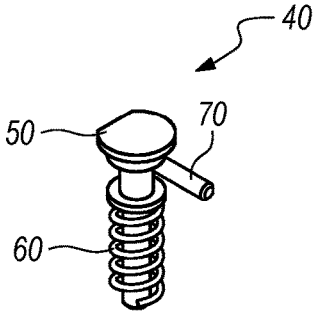
FIG. 4 is a perspective view of magazine release button interference pin assembly.
Figure 5:
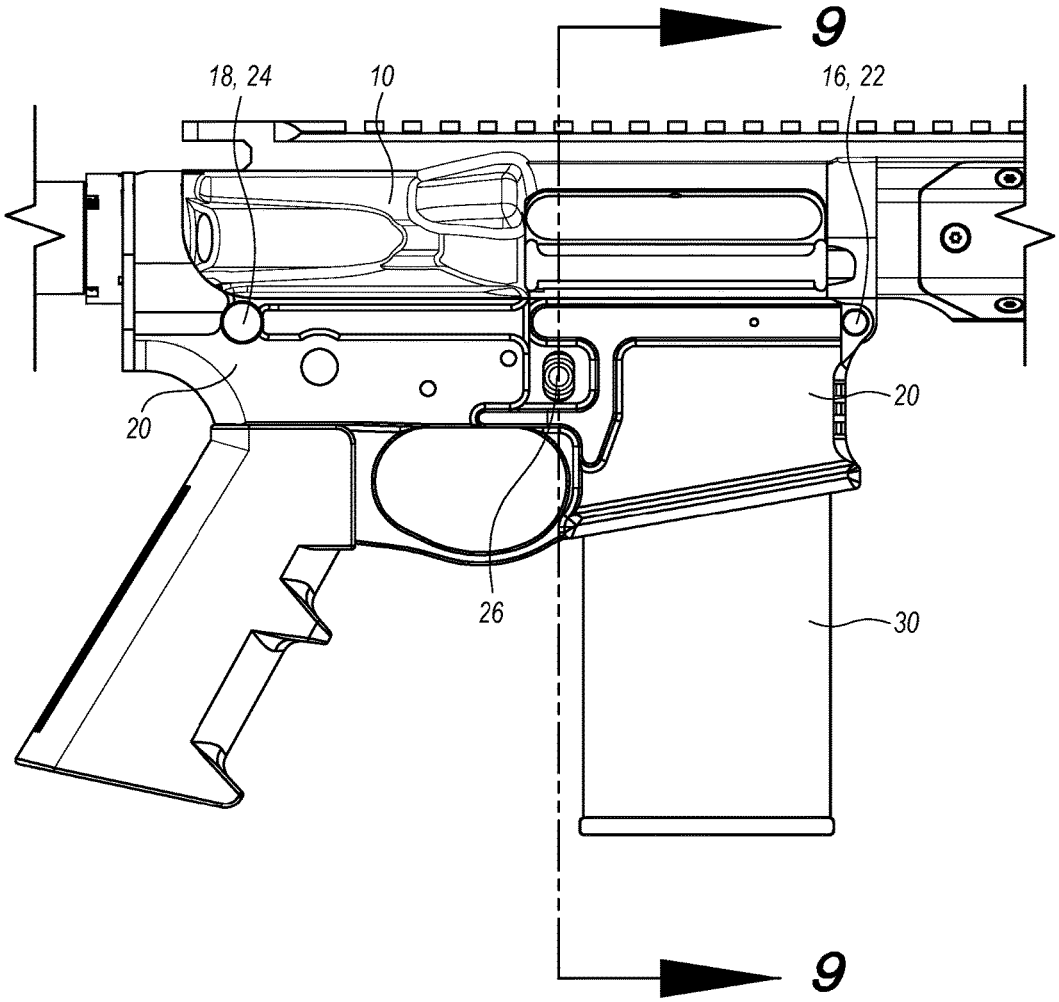
FIG. 5 is an enlarged right side elevation view of an AR-Style rifle with the upper receiver closed onto and attached to the lower receiver with the takedown pin fully inserted.
Figure 6:
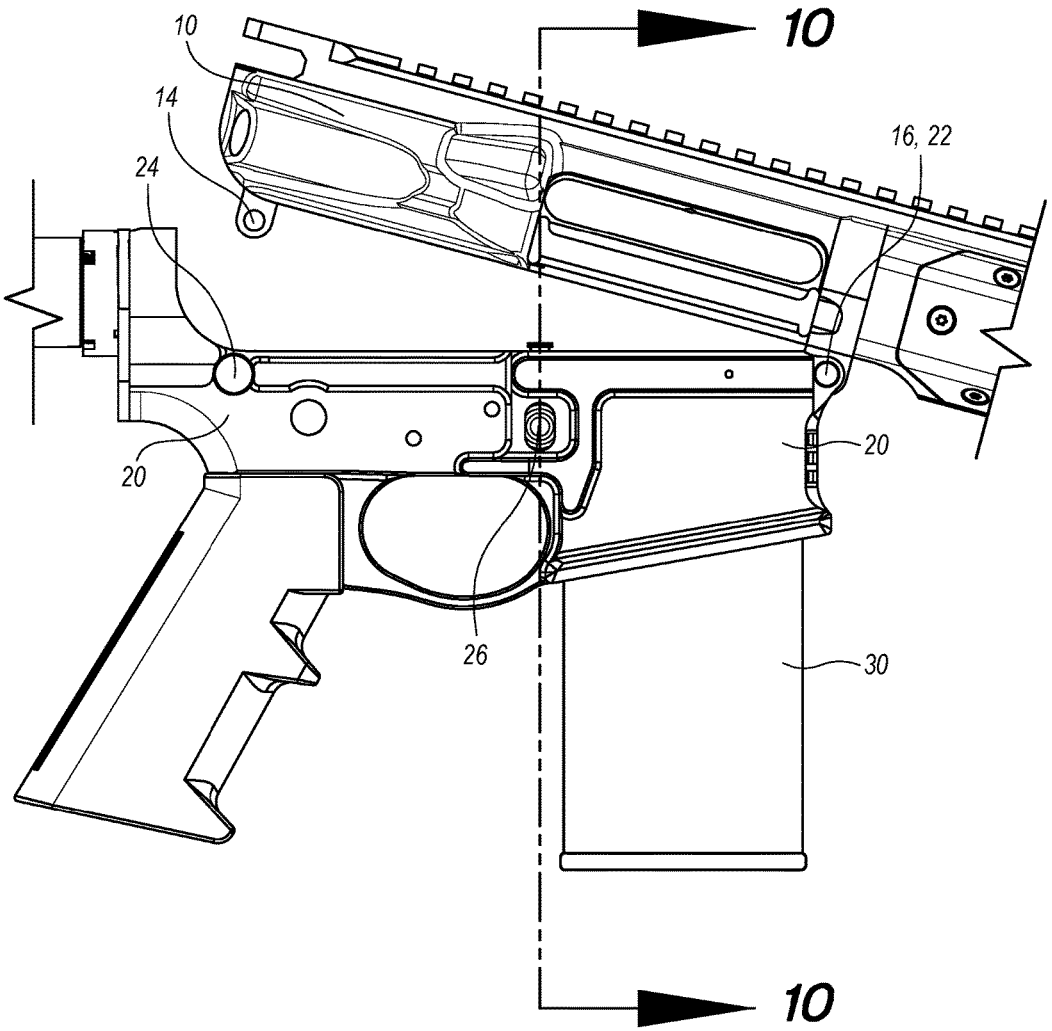
FIG. 6 is an enlarged right side elevation view of an AR-Style rifle with the upper receiver opened or pivoted away from the lower receiver with the takedown pin removed.

| Term | Definition |
|---|---|
| 10 | AR-Style Upper Receiver |
| 12 | Pivot Pin Hole on Upper Receiver |
| 14 | Takedown Pin Hole on Upper Receiver |
| 16 | Pivot Pin |
| 18 | Takedown Pin |
| 20 | AR-Style Lower Receiver |
| 21 | First Pivot Pin Hole on Lower Receiver |
| 22 | Second Pivot Pin Hole on Lower Receiver |
| 23 | First Takedown Pin Hole on Lower Receiver |
| 24 | Second Takedown Pin Hole on Lower Receiver |
| 25 | Bolt Catch Slot |
| 26 | Magazine Release Button |
| 27 | Magazine Release Button Cavity |
| 28 | Magazine Catch |
| 30 | Magazine |
| 32 | Magazine Catch Notch |
| 40 | Magazine Release Button Interference Pin Assembly |
| 50 | Magazine Release Button Interference Pin (MRBIP) |
| 51 | First Segment on MRBIP |
| 52 | First Protrusion on MRBIP |
| 54 | Second Segment on MRBIP |
| 56 | Second Protrusion on MRBIP |
| 58 | Head on MRBIP |
| 60 | Magazine Release Button Interference Pin Spring |
| 70 | Magazine Release Button Interference Pin Retaining Pin |
| 80 | Magazine Release Button Interference Pin Hole |
| 82 | First Segment on MRBIP Hole |
| 84 | Second Segment on MRBIP Hole |
| 86 | Third Segment on MRBIP Hole |
| 90 | Magazine Release Button Interference Pin Retaining Pin Hole |
| 95 | AR-Style Lower Receiver with Magazine Release Button Interference Pin Assembly |
| 100 | AR-Style Rifle |
| 102 | Buttstock |
| 104 | Barrel |

DETAILED DESCRIPTION OF THE INVENTION

An AR-Style rifle 100 comprises: various subcomponents such as pins, springs, fasteners, buttons, bushings, levers, grip, trigger, and various other components, which have come to be known as standard sub-components on every AR-Style rifle 100. Among the standard sub-components on any AR-Style rifle 100 are: a buttstock 102 and a barrel 104. A buttstock 102 is a rigid oblong member attached to the proximal end of lower receiver 20. A barrel 104 is a rigid hollow cylindrical member attached to the distal end of upper receiver 10.

Also among the standard subcomponents on any AR-Style rifle 100 are: an upper receiver 10 and a lower receiver 20. Upper receiver 10 and lower receiver 20 are each standard components that are a component of every AR-Style rifle 100. Upper receiver 10 and lower receiver 20 are each rigid oblong members with a longitudinal axis, a proximal end, a distal end, a left surface, a right surface, an upper surface, a lower surface, and various holes, cavities, threads, and other features that are present on every AR-Style rifle 100. Upper receiver 10 and lower receiver 20, each with their various holes, cavities, threads, and other features have come to be known as standard features on every AR-Style rifle 100. The proximal end is defined as the end of subject component that is closest to the operator of the rifle or shooter. The distal end is defined as the end of the subject component that is farthest from the operator of the rifle or shooter. The right surface is defined as the surface of the subject component that faces the right side of the operator of the rifle or shooter. The left surface is defined as the surface of the subject component that is faces the left side the operator of the rifle or shooter. The upper surface is defined as the side of the subject component that faces upwards. The lower surface is defined as the side of the subject component that faces downwards.

Among the standard features on any upper receiver 10 are: a pivot pin hole 12 and a takedown pin hole 14. Pivot pin hole 12 on upper receiver 10 is a cylindrical void on the lower surface of upper receiver 10 at the distal end. Pivot pin hole 12 has an inside diameter and a longitudinal axis that runs perpendicular to that of upper receiver 10. Pivot pin hole 12 is located on a distal protrusion or finger member that protrudes downwards from the lower surface of upper receiver 10 at the distal end of the lower surface. Takedown pin hole 14 on upper receiver 10 is a cylindrical void on the lower surface of upper receiver 10 at the proximal end. Takedown pin hole 14 has an inside diameter and a longitudinal axis that runs perpendicular to that of upper receiver 10. Takedown pin hole 14 is located on a proximal protrusion or finger member that protrudes downwards from the lower surface of upper receiver 10 at the proximal end of the lower surface. The inside diameter of pivot pin hole 12 on upper receiver 10 is equivalent to that of first and second pivot pin holes 21,22 on lower receiver 20. The inside diameter of takedown pin hole 14 on upper receiver 10 is equivalent to that of first and second takedown pin holes 23,24 on lower receiver 20.

Among the standard features on any lower receiver 20 are: a first pivot pin hole 21, a second pivot pin hole 22, a first takedown pin hole 23, and a second takedown pin hole 24. First and second pivot pin holes 21,22 on lower receiver 20 are each a cylindrical void on the distal end of lower receiver 20. First and second pivot pin holes 21,22 each have an inside diameter and a longitudinal axis that runs perpendicular to that of lower receiver 20. The longitudinal axis of first pivot pin hole 21 on lower receiver 20 is coincident with that of second pivot pin hole 22 on lower receiver 20. The inside diameters of first and second pivot pin holes 21,22 are equivalent. First pivot pin hole pin 21 is located on a first protrusion or finger member that protrudes in the distal direction from the distal end of lower receiver 20. First protrusion is located at the upper left corner of the distal end of lower receiver 20 as depicted. Second pivot pin hole pin 22 is located on a second protrusion or finger member that protrudes in the distal direction from the distal end of lower receiver 20. Second protrusion is located at the upper right corner of the distal end of lower receiver 20 as depicted. First and second takedown pin holes 23,24 on the lower receiver 20 are each a cylindrical void through lower receiver located near the proximal end of lower receiver 20. First and second takedown pin holes 23,24 each have an inside diameter and a longitudinal axis that runs perpendicular to that of lower receiver 20. The longitudinal axis of first takedown pin hole 23 on lower receiver 20 is coincident with that of second takedown pin hole 24 on lower receiver 20. The inside diameters of first and second takedown pin holes 23,24 are equivalent. First takedown pin hole 23 is located on the left surface of lower receiver 20, near the proximal end of lower receiver 20, as depicted. Second takedown pin hole 24 is located on the right surface of lower receiver 20, near the proximal end of lower receiver 20, as depicted. There is a cavity between first and second takedown pin holes 23,24 as depicted that functions to provide clearance space for the trigger assembly (not depicted).

Also among the standard features on any lower receiver 20 is a bolt catch slot 25. Bolt catch slot 25 is an oblong slot in upper surface of lower receiver 20 running perpendicular to the longitudinal axis of lower receiver 20. Bolt catch slot 25 breaks through the left surface of lower receiver 20 as depicted. Bolt catch slot 25 does not break through the right surface of lower receiver 20 as depicted. Bolt catch slot 25 functions to provide clearance between a bolt catch (not depicted) and a bolt (not depicted). A bolt catch is fitted within bolt catch slot 25. Bolt catch functions to catch the bolt in the reward position and to release of the bolt from the rearward position. The left end of bolt catch protrudes partially out of bolt catch slot 25 at the break through point on the left surface of lower receiver 20. This left end protrusion functions as a button or lever with which to operate the bolt catch.

Also among the standard subcomponents on any AR-Style rifle 100 are: a magazine release button 26 and a magazine catch 28. Magazine release button 26 is a spring-loaded button located on the right surface of lower receiver 20 as depicted. Magazine release button 26 is spring-loaded by a magazine catch spring (not depicted) that functions to push or force the magazine release button 26 in the "out" position, but allows the magazine release button 26 to be depressed to the "in" position under the standard pressure of pushing on the magazine release button 26 with your finger. The "out" position of magazine release button 26 is towards the right in FIGS. 9-11. The "in" position of magazine release button 26 is towards the left in FIGS. 9-11. Magazine catch 28 is a solid rigid member that functions to attach onto or lock into a magazine catch notch 32 on a magazine 30 when magazine release button 26 is in the "out" position and to detach from or release from magazine catch notch 32 on magazine 30 when magazine release button 26 is in the "in" position. Magazine release button 26 is mechanically linked to magazine catch 28 through magazine catch spring. When magazine release button 26 is depressed, it forces magazine catch spring to push magazine catch 28 outwards from the left surface of lower receiver 20 and or toward the left in FIGS. 9-11, thereby removing magazine catch 28 from its insertion point in magazine catch notch 32.

Also among the standard subcomponents on any AR-Style rifle 100 are: a magazine 30 with a magazine catch notch 32. Magazine 30 is a container or housing that stores bullets of rounds of ammunition (not depicted). Magazine 30 functions to store bullets and feed a bullet one at a time into a chamber to fire the bullet from the rifle 100. Magazine 30 has a proximal end, a distal end, a left surface, a right surface, an upper opening, and a lower surface. Magazine catch notch 32 is a notch, slot, or depression in the left surface of magazine 30 near the upper end of the left surface as depicted. As stated above, magazine catch 28 locks into or attaches within magazine catch notch 32 when magazine release button 26 is at rest, and releases from or detaches from magazine catch notch 32 when magazine release button 26 is depressed.

Also among the standard subcomponents on any AR-Style rifle 100 are: a pivot pin 16 and a takedown pin 18. Pivot pin 16 is a solid rigid cylindrical member with an outer diameter, a first end, and a second end. The outside diameter of pivot pin 16 is sized to make a slip fit or press fit with the inside diameter of pivot pin hole 12 on upper receiver 10 and the inside diameters of first and second pivot pin holes 23,24 on lower receiver 20. The first end of pivot pin 16 has no head. The second end of pivot pin 16 has a head with an outside diameter that is larger than the inside diameter of first and second pivot pin holes 23,24 on lower receiver 20. Takedown pin 18 is a solid rigid cylindrical member with an outer diameter, a first end, and a second end. The outside diameter of takedown pin 18 is sized to make a slip fit or press fit with the inside diameter of takedown pin hole 14 on the upper receiver 10 and the inside diameters of the first and second takedown pin holes 23,24 on the lower receiver 20. The first end of takedown pin 18 has no head. The second end of takedown pin 18 has a head with an outside diameter that is larger than the inside diameter of first and second takedown pin holes 23,24 on lower receiver. As with all AR-Style rifles 100, the upper receiver 10 is pivotally attached to the lower receiver 20 with pivot pin 16. In order to pivotally attach upper receiver 10 to lower receiver 20, the longitudinal axis of pivot pin hole 12 on upper receiver 10 is aligned with that of first and second pivot pin holes 21,22 on lower receiver 20 so that the distal protrusion on upper receiver 10 is placed between the first and second protrusions on lower receiver 20. Then the first end of pivot pin 16 is inserted through the second pivot pin hole 22 on lower receiver 20, pivot pin hole 12 on upper receiver 10, and first pivot pin hole 21 on lower receiver 20 until the head on the second end of pivot pin 16 contacts the right surface of lower receiver 20. Pivotal attachment is such that a hinge is formed between the upper receiver 10 and the lower receiver 20 with the pivot pin 16 acting as a hinge pin.

As with all AR-Style rifles 100, after the upper receiver 10 has been pivotally attached to the lower receiver 20, the upper receiver 10 is locked onto the lower receiver 20 using takedown pin 18. The upper receiver 10 must be locked onto lower receiver 20 in order to fire the rifle 100. In order to lock the upper receiver 10 onto the lower receiver 20, the longitudinal axis of takedown pin hole 14 on upper receiver 10 is aligned with that of first and second takedown pin holes 23,24 on lower receiver 20 so that the proximal protrusion on upper receiver 10 is located in the void or cavity between first and second takedown pin holes 23,24. Then the first end of takedown pin 18 is inserted through the second takedown pin hole 24 on lower receiver 20, takedown pin hole 14 on upper receiver 10, and first takedown pin hole 23 on lower receiver 20 until the head on the second end of takedown pin 18 contacts the right of surface lower receiver 20. This attachment is such that the upper receiver 10 is locked onto the lower receiver 20 with rigid and strong attachment by pivot pin 16 and takedown pin 18.

As with all AR-Style rifles 100, in order to unlock upper receiver 10 from lower receiver 20, the operator must press the first end of takedown pin 18 out of: first takedown pin hole 23, takedown pin hole 14, and second takedown pin hole 24 to eject takedown pin 18 from these holes. This allows the proximal end of upper receiver 10 to be pivoted upwards and away from the proximal end of lower receiver 20 where pivoting occurs around pivot pin 16.

As with all AR-Style rifles 100, in order to remove upper receiver 10 from lower receiver 20, the operator must press the first end of pivot pin 16 out of: first pivot pin hole 21 and second pivot pin hole 22 to eject pivot pin 16 from these holes. This allows the upper receiver 10 to be removed from the lower receiver 20. The takedown pin 18 must also be removed in order to remove upper receiver from lower receiver 20.

Figure 7:
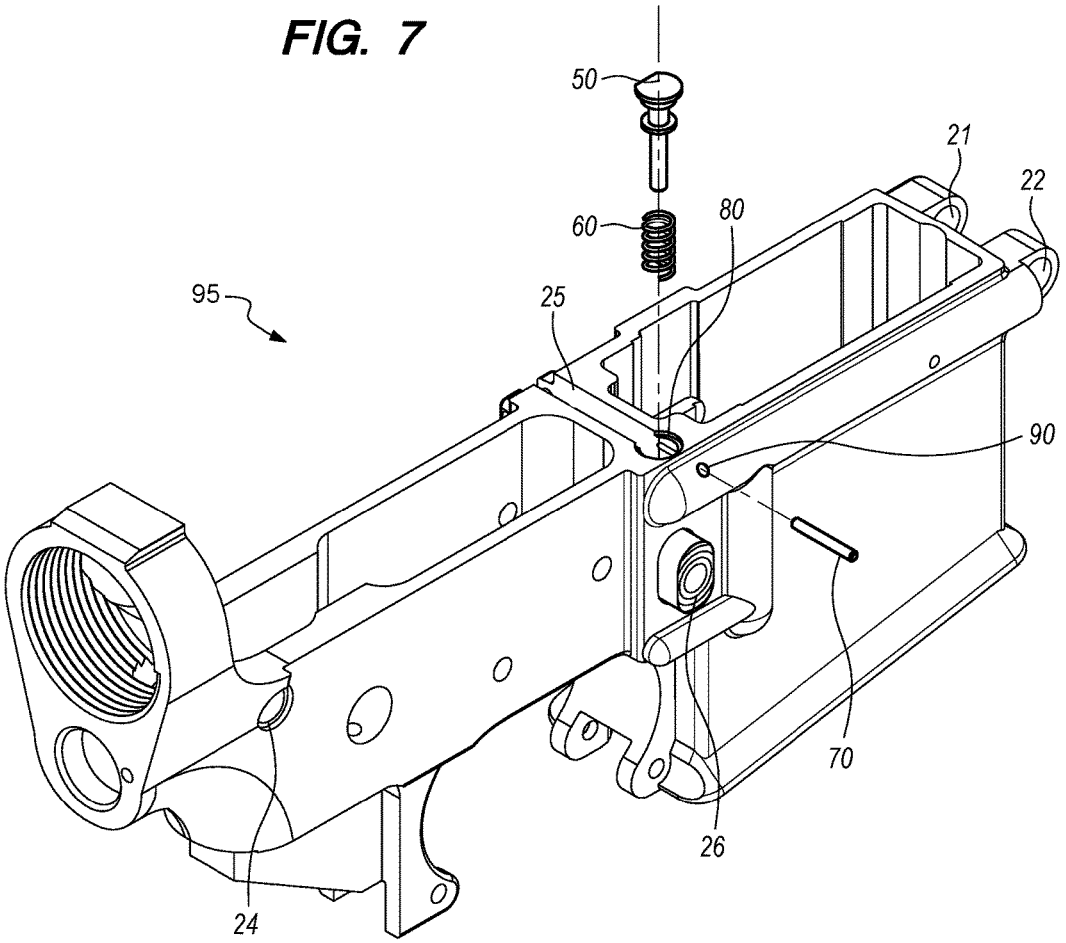
FIG. 7 is a perspective view of a lower receiver machined for a magazine release button interference pin assembly with an exploded view of a magazine release button interference pin assembly.
Figure 8:
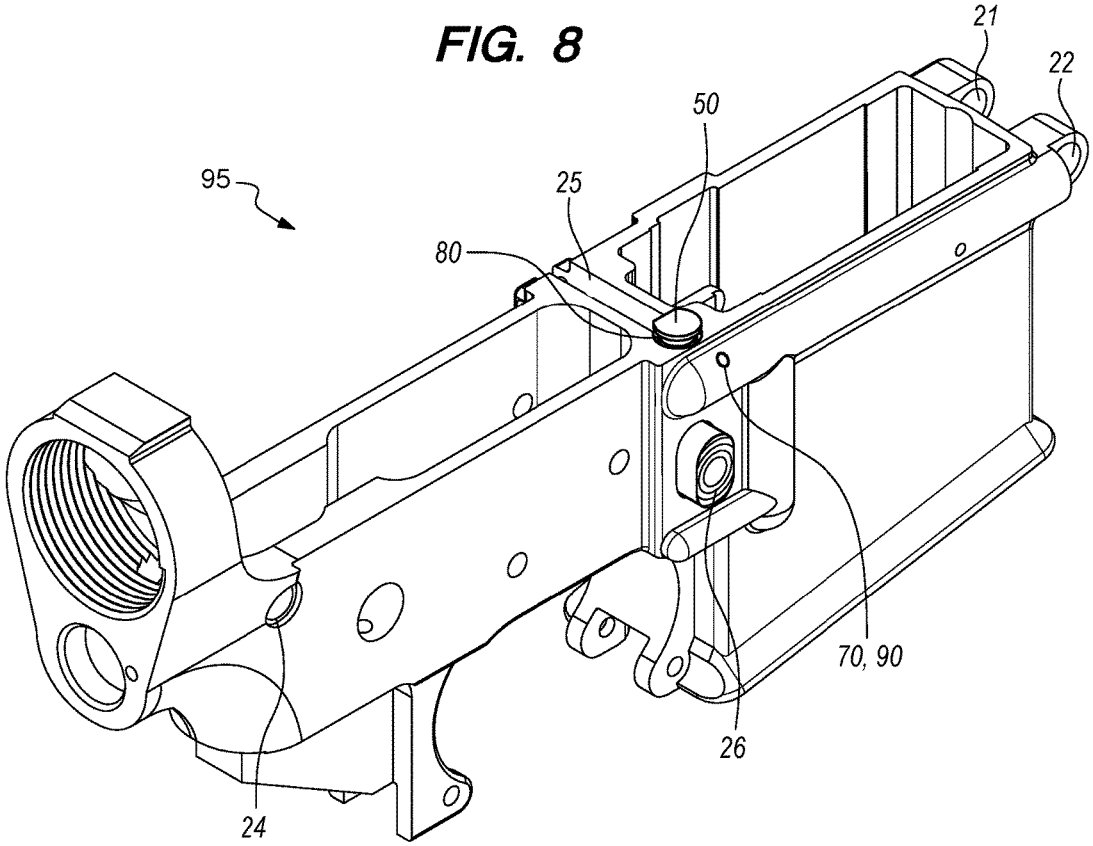
FIG. 8 is a perspective view of a lower receiver machined for and fitted with a magazine release button interference pin assembly.

Prior art AR-Style rifles 100 contain all items described in the above portion of the detailed description. Prior art AR-Style rifles 100 do not contain the magazine release button interference pin assembly 40 as described below. Also, prior art lower receivers 20 do not include the magazine release button interference pin hole 80 and magazine release button interference pin retaining pin hole 90 as described below. FIGS. 7-8 depict an AR-Style lower receiver with magazine release button interference pin assembly 95.

Magazine release button interference pin assembly 40 comprises: a magazine release button interference pin 50, a magazine release button interference pin spring 60, and a magazine release button interference pin retaining pin 70.

Magazine release button interference pin 50 is a solid rigid oblong member comprising: a first segment 51, a first protrusion 52, a second segment 54, and a second protrusion 56. Magazine release button interference pin 50 is made from a solid and durable material such as metal, metal alloy, steel alloy, ceramic, or other material. In best mode, magazine release button interference pin 50 is made of steel alloy. First segment 51 is contiguous with first protrusion 52, which is contiguous with second segment 54, which is contiguous with a second protrusion 56, as depicted. All together, first segment 51, first protrusion 52, second segment 54, and second protrusion 56 comprise the solid rigid oblong member. Magazine release button interference pin 50 has an overall length that is the sum of lengths/thicknesses of all segments 51,52,54,56. In best mode, first segment 51, first protrusion 52, second segment 54, and second protrusion 56 are part of the same piece of material and have been machined from one piece of material. Magazine release button interference pin 50 functions to interfere with or otherwise prevent the depression of magazine release button 26 when the upper receiver 10 is closed or locked onto the lower receiver 20, but allow the depression thereof when the upper receiver 10 is opened or pivoted away from the lower receiver 10.

First segment 51 is a solid rigid cylindrical member with a length, a diameter, a longitudinal axis, a side, an upper end, and a lower end. The length of first segment 51 is 0.2-0.8 inches. The diameter of first segment 51 is 0.025-0.200 inches. The longitudinal axis runs through the longitudinal center of the cylindrical member. First segment 51 functions to interfere with the function of the magazine release button 26 when in the lower position.

First protrusion 52 is a solid rigid cylindrical member with a thickness, an outside diameter, a center point, an upper surface, and a lower surface. The thickness of first protrusion 52 is 0.01-0.5 inches. The outside diameter of first protrusion 52 is 0.100-0.300 inches. The outside diameter of first protrusion 52 is larger than the diameters of first and second segments 51,54. The longitudinal axis of first segment 51 is coincident with the center point of first protrusion 52. The upper end of first segment 51 is contiguous with and rigidly attached to the lower surface of first protrusion 52. In best mode, first segment 51 and first protrusion 52 are made from the same piece of material. First protrusion 52 functions to retain magazine release button interference pin spring 60 within magazine release button interference pin hole 80 below first protrusion 52. First protrusion 52 functions to also retain magazine release button interference pin 50 within magazine release button interference pin hole 80 when the upper receiver 10 is opened, detached, or pivoted away from the lower receiver 20.

Second segment 54 is a solid rigid cylindrical member with a length, a diameter, a longitudinal axis, an upper end, and a lower end. The length of second segment 54 is 0.05-0.5 inches. The diameter of second segment 54 is 0.025-0.200 inches. The longitudinal axis runs through the longitudinal center of the cylindrical member. First segment 51 and second segment 54 may have the same diameter. In best mode, first segment 51 and second segment 54 have the same diameter. The upper surface of first protrusion 52 is contiguous with and rigidly attached to the lower end of second segment 54. The longitudinal axis of first segment 51 is coincident with that of second protrusion 56. In best mode, first protrusion 52 and second segment 54 are made from the same piece of material.

Second protrusion 56 is a solid rigid cylindrical member with a thickness, an outside diameter, a center point, an upper end, and a lower surface. The thickness of second protrusion 56 is 0.01-0.5 inches. The outside diameter of second protrusion 56 is 0.100-0.300 inches. The outside diameter of second protrusion 56 is larger than the diameters of first and second segments 51,54. The longitudinal axis of second segment 54 is coincident with the center point of second protrusion 56. First protrusion 52 and second protrusion 56 may have the same outside diameter. In best mode, first protrusion 52 and second protrusion 56 have the same outside diameter. The upper end of second segment 54 is contiguous with and rigidly attached to the lower surface of second protrusion 56. In best mode, second segment 54 and second protrusion 56 are made from the same piece of material. Second protrusion 56 functions to prevent the magazine release button interference pin 50 from moving too far downwards to press against or bottom out on the magazine release button 26 when magazine release button interference pin 50 is in the lower position. The upper end of second protrusion 56 is flush with the upper surface of lower receiver 20 when magazine release button interference pin 50 is in the lower position.

Optionally, magazine release button interference pin 50 may further comprise a head 58. Head 58 is not required for successful functioning of the invention but adds to the esthetics of magazine release button interference pin assembly 40 when installed into lower receiver 20 by eliminating any gaps between magazine release button interference pin 50 and magazine release button interference pin hole 80. Head 58 is a solid rigid cylindrical member with a thickness, an outside diameter, a center point, a keyed side, an upper surface, and a lower surface. The upper end of head 58 is flush with the upper surface of lower receiver 20 when magazine release button interference pin 50 is in the lower position. The thickness of head 58 is 0.01-0.1 inches. The outside diameter of head 58 is 0.100-0.500 inches. The center points of first protrusion 52, second protrusions 56, and head 58 are each coincident with the longitudinal axes of first and second segments 51,54. Keyed side is a portion of the side of cylindrical member that has been removed to yield a straight edge. Keyed side is a straight edge on one side of the cylindrical member. The keyed side is required to provide clearance for the bolt catch (not depicted) and bolt catch slot 25. Without the keyed side on head 58, head 58 would overhang into the space occupied by the bolt catch slot 25 to interfere with the motion of the bolt catch within the bolt catch slot 25. The outside diameter of head 58 must be larger than that of second protrusion 56. The upper end of second protrusion 56 is contiguous with and rigidly attached to the lower surface of head 58. In best mode, second protrusion 56 and head 58 are made from the same piece of material.

Magazine release button interference pin spring 60 is helical spring or coil spring with a length, a diameter, a longitudinal axis, an upper end, and a lower end. Magazine release button interference pin spring 60 is a typical or standard helical spring or coil spring. The length of magazine release button interference pin spring 60 is 0.150-0.600 inches. The length of magazine release button interference pin spring 60 is about the same as the length of first segment 51. The diameter of magazine release button interference pin spring 60 is 0.050-0.300 inches. The longitudinal axis of magazine release button interference pin spring 60 runs through the longitudinal center of magazine release button interference pin spring 60. The longitudinal axes of first and second segments 51,52 are concentric with the longitudinal axis of magazine release button interference pin spring 60. Magazine release button interference pin spring 60 functions to apply upward pressure or force on the magazine release button interference pin 50 to push and move magazine release button interference pin 50 upwards when the upper receiver 10 is opened, detached, or pivoted away from the lower receiver 20. Magazine release button interference pin spring 60 is installed over first segment 51 as described below.

Magazine release button interference pin retaining pin 70 is a solid rigid cylindrical member with a length, a diameter, a longitudinal axis, a left end, a right end, an upper surface, and a lower surface. The length of cylindrical member is 0.100-0.600 inches. The length of magazine release button interference pin retaining pin 70 must be long enough so magazine release button interference pin retaining pin 70 penetrates into the bolt catch slot 25 when installed into a lower receiver 20. The diameter of cylindrical member is 0.020-0.250 inches. The diameter of magazine release button interference pin retaining pin 70 must be less than the length of second segment 54. Magazine release button interference pin retaining pin 70 is made from a solid and durable material such as metal, metal alloy, steel alloy, ceramic, or other material. Magazine release button interference pin retaining pin 70 functions to retain magazine release button interference pin 50 within magazine release button interference pin hole 80 when the upper receiver 10 is opened, detached, or pivoted away from the lower receiver 20 and magazine release button interference pin when spring 60 pushes magazine release button interference pin 50 upwards. The upper surface of first protrusion 52 rests against or contacts the lower surface of magazine release button interference pin 50 to facilitate this retention. In best mode, magazine release button interference pin retaining pin 70 is made of steel alloy.

Magazine release button interference pin hole 80 is a specially shaped hole or void that has been machined into the lower receiver 20. Magazine release button interference pin hole 80 comprises: a first segment 82 and a second segment 84.

First segment 82 is a cylindrical hole or cavity in lower receiver 20 with a length, an inside diameter, a longitudinal axis, an upper end, and a lower end. The length of first segment 82 is 10-45 percent of that of first segment 51 of magazine release button interference pin 50. The inside diameter of first segment 82 is sized to make a slip-fit with the outside diameter of the first segment 51 of magazine release button interference pin 50. "Slip-fit" is a commonly known engineering classification that is defined as a sliding clearance fit between a pin and a hole where the hole has a diameter just slightly larger than that of the pin so that the pin may slide into and out of the hole with finger pressure. First segment 82 is the deepest section of magazine release button interference pin hole 80.

Second segment 84 is a cylindrical hole or cavity in lower receiver 20 with a length, an inside diameter, a longitudinal axis, an upper end, and a lower end. The length of second segment 84 is 60-90 percent of the overall length of magazine release button interference pin 50. The inside diameter of second segment 84 is sized to make a slip-fit with the outside diameter of first protrusion 52 or first and second protrusion 52,56 on magazine release button interference pin 50. The inside diameter of second segment 84 is larger than that of first segment 82. The upper end of first segment 82 of magazine release button interference pin hole 80 is contiguous with the lower end of second segment 84 of magazine release button interference pin hole 80. The cavity of first segment 82 is contiguous with the cavity of second segment 84 to make one continuous cavity as depicted. The longitudinal axis of first segment 82 is coincident with that of second segment 84.

Figure 9:
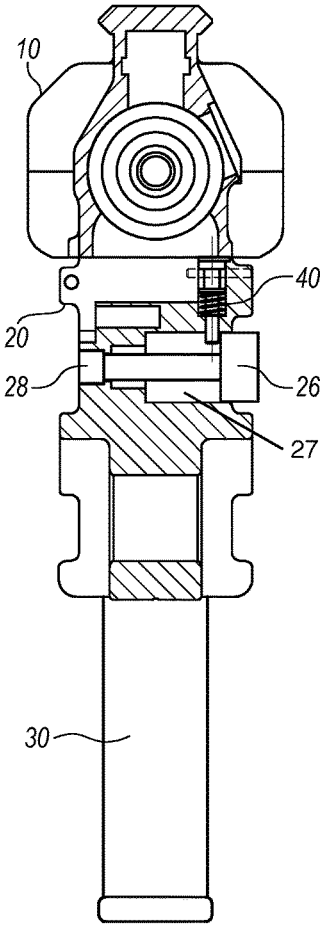
FIG. 9 is a cross-section view taken from line 9-9 in FIG. 5.
Figure 10:
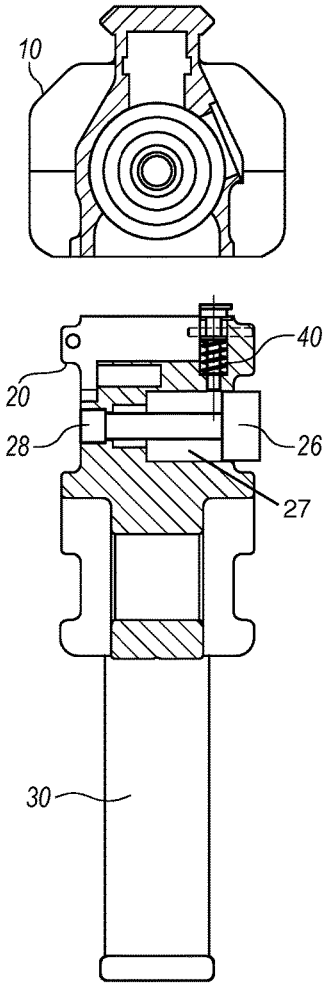
FIG. 10 a cross-section view taken from line 10-10 in FIG. 6.
Figure 11:
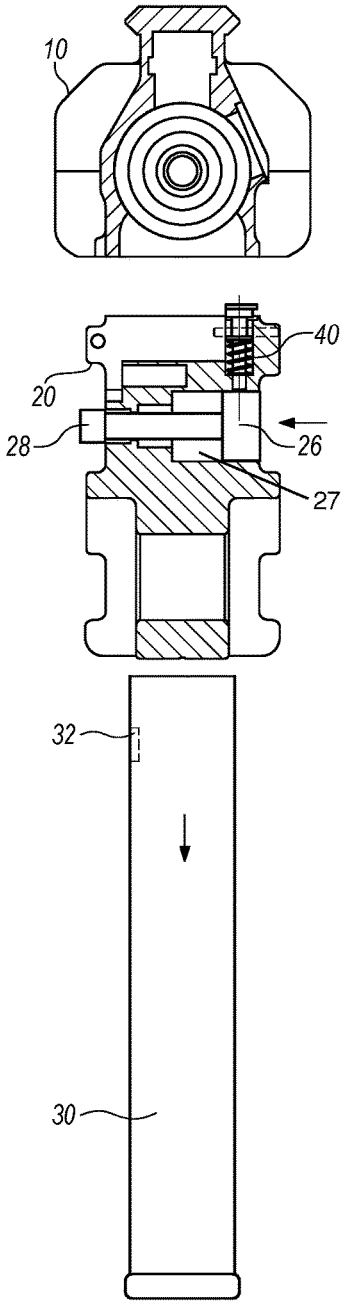
FIG. 11 is FIG. 10 with the magazine release button depressed, to move magazine catch leftwards, to release magazine, which falls downwards and out of lower receiver.

The longitudinal axis of magazine release button interference pin hole 80 is perpendicular to the longitudinal axis of lower receiver 20. The lower end of first segment 82 of magazine release button interference pin hole 80 breaks out into the magazine release button cavity 27. The magazine release button cavity 27 is a cavity that is a standard features on every AR-Style rifle 100. The magazine release button cavity 27 is a cavity machined into lower receiver 20. The magazine release button 26 is installed into the magazine release button cavity 27. The magazine release button cavity 27 provides clearance space for the magazine release button 26 to be depressed and released or operated. FIGS. 9 and 10 depict magazine release button 26 and magazine release button cavity 27 when magazine release button 26 is in the released position. FIG. 11 depicts magazine release button 26 and magazine release button cavity 27 when magazine release button 26 is in the depressed position. The upper end of second segment 84 breaks out through the upper surface of lower receiver 20 without optional third segment 86 as described below. In best mode, a longitudinal section or portion of second segment 84 breaks out into the bolt catch slot 25 as depicted but this is not required for successful functioning of the invention.

Optionally, magazine release button interference pin hole 80 may further comprise a third segment 86. Third segment 86 provides clearance for head 58 on magazine release button interference pin 50. Third segment 86 is only required when head 58 is optionally included on magazine release button interference pin 50. Third segment 86 is a cylindrical hole or cavity in lower receiver 20 with a length, an inside diameter, a longitudinal axis, an upper end, and a lower end. The length of third segment 86 is the thickness of the head 58 of magazine release button interference pin 50, or just slightly longer than that. The inside diameter of third segment 86 is sized to make a slip-fit with the outside diameter of head 58 on magazine release button interference pin 50. The inside diameter of third segment 86 is larger than that of second segment 84. The upper end of second segment 84 of magazine release button interference pin hole 80 is contiguous with the lower end of third segment 86 of magazine release button interference pin hole 80. The cavity of second segment 84 is contiguous with the cavity of third segment 86 to make one continuous cavity as depicted. The longitudinal axis of second segment 84 is coincident with that of third segment 86. The upper end of third segment 86 breaks out through the upper surface of lower receiver 20. In best mode, a longitudinal section or portion of third segment 86 breaks out into the bolt catch slot 25 as depicted but this is not required for successful functioning of the invention.

Magazine release button interference pin retaining pin hole 90 is a cylindrical hole or cavity in lower receiver 20 with a length, an inside diameter, a longitudinal axis, an left end, and a right end. The length of magazine release button interference pin retaining pin hole 90 is 25-75 percent of that of magazine release button interference pin retaining pin 70. The inside diameter of magazine release button interference pin retaining pin hole 90 is sized to make a slip-fit or press fit with the outside diameter of magazine release button interference pin retaining pin 70. "Press fit" is a commonly known engineering classification that is defined as interference fit between a pin and a hole where the hole has a diameter just slightly smaller than that of the pin so that the pin must be pressed with force greater than that of finger pressure in order to insert or remove the pin from the hole, where a hammer and punch tool are typically used to remove and insert the pin. The longitudinal axis of magazine release button interference pin retaining pin hole 90 is perpendicular to that of magazine release button interference pin hole 80. Magazine release button interference pin retaining pin hole 90 is positioned and located on lower receiver 20 so that its left end breaks out into the magazine release button interference pin hole 80 as depicted and so that its right end breaks out of the right surface of lower receiver 20 as depicted.

Magazine release button interference pin assembly 40 is installed into a specially machined lower receiver 20 as follows. Magazine release button interference pin spring 60 is positioned over first segment 51 of magazine release button interference pin 50 by sliding the upper end of magazine release button interference pin spring 60 onto the lower end of first segment 51 and sliding the upper end of magazine release button interference pin spring 60 upwards until it rests against or contacts the lower surface of first protrusion 52 of magazine release button interference pin 50. To install magazine release button interference pin 50 and magazine release button interference pin spring 60 into specially machined lower receiver 20, the lower end of first segment 51 of magazine release button interference pin 50 is inserted into the upper end of third segment 86 of magazine release button interference pin hole 80 and the magazine release button interference pin 50 is pressed downwards until the lower surface of head 58 on magazine release button interference pin 50 contacts or rests against the lower end of third segment 86 of magazine release button interference pin hole 80 or seats within the third segment 86 of magazine release button interference pin hole 80. You must keep continuous downward pressure on magazine release button interference pin 50 to install magazine release button interference pin retaining pin 70. To install the magazine release button interference pin retaining pin 70, the left end of magazine release button interference pin retaining pin 70 is inserted into the right end of magazine release button interference pin retaining pin hole 90 and the magazine release button interference pin retaining pin 70 is pressed into magazine release button interference pin retaining pin hole 90 until the right end of magazine release button interference pin retaining pin 70 is flush with the right surface of lower receiver 20. As stated, the length of magazine release button interference pin retaining pin 70 must be long enough to break out into magazine release button interference hole 80. With the magazine release button interference pin retaining pin 70 installed, you can release the continuous downward pressure on magazine release button interference pin 50. If magazine release button interference pin assembly 40 is properly installed, when downward pressure on magazine release button interference pin 50 is released, the upper surface of first protrusion 52 of magazine release button interference pin 50 rests against the lower surface of magazine release button interference pin retaining pin 70 to retain magazine release button interference pin 50 within magazine release button interference pin hole 80 as depicted in FIGS. 10 and 11. This is designated as the upper position of magazine release button interference pin 50. If magazine release button interference pin assembly 40 is properly installed, when the upper receiver 10 is closed onto or locked to the lower receiver 20, continuous downward pressure is applied to magazine release button interference pin 50 to force magazine release button interference pin 50 downwards so that the lower end of first segment 51 of magazine release button interference pin 50 breaks out into magazine release button cavity 27 as depicted in FIG. 9. This is designated as the lower position of magazine release button interference pin 50.

When magazine release button interference pin 50 is in the lower position, magazine release button 26 may not be depressed because the side of first segment 51 of magazine release button interference pin 50 interferes with or blocks the path of depression of the magazine release button 26. When magazine release button interference pin 50 is in the lower position and magazine release button 26 is in the released position, there is no contact between the side of first segment 51 and the magazine release button 26. Contact between the magazine release button 26 and magazine release button interference pin 50 only occurs when magazine release button interference pin 50 is in the lower position and magazine release button interference pin 50 is depressed. When magazine release button interference pin 50 is in the lower position and magazine release button interference pin 50 is depressed, the magazine release button 26 contacts the side of first segment 51. The lower end of first segment 51 is prevented from contacting the magazine release button 26 when magazine release button interference pin 50 is in the lower position, because the lower surface of second protrusion 56 of magazine release button interference pin 50 contacts the upper surface of magazine release button interference pin retaining pin 70 to prevent the lower end of magazine release button interference pin 50 from moving downwards far enough to contact the magazine release button 26. When magazine release button interference pin 50 is in the upper position, magazine release button 26 may be depressed because magazine release button interference pin 50 does not interfere with or block the path of depression of magazine release button 26.

What is claimed is:

1. A magazine release button interference pin assembly comprising: a magazine release button interference pin; a magazine release button interference pin spring; and a magazine release button interference pin retaining pin; wherein, said magazine release button interference pin is a solid rigid oblong member with: a first segment; a first protrusion; a second segment; and a second protrusion; wherein, said first segment is a solid rigid cylindrical member with a length, a diameter, a longitudinal axis, an upper end, and a lower end, said first protrusion is a solid rigid cylindrical member a thickness, an outside diameter, a center point, an upper surface, and a lower surface, said outside diameter of said first protrusion is larger than said diameter of said first segment and said diameter of said second segment, said longitudinal axis of said first segment is coincident with said center point of said first protrusion, said upper end of said first segment is contiguous with and rigidly attached to said lower surface of said first protrusion, said second segment is a solid rigid cylindrical member with a length, a diameter, a longitudinal axis, an upper end, and a lower end, said upper surface of said first protrusion is contiguous with and rigidly attached to said lower end of said second segment, said longitudinal axis of said first segment is coincident with said longitudinal axis of said second protrusion, said second protrusion is a solid rigid cylindrical member with a thickness, an outside diameter, a center point, an upper end, and a lower surface, said outside diameter of said second protrusion is larger than said diameter of said first segment and said diameter of said second segment, said longitudinal axis of said second segment is coincident with said center point of said second protrusion, said upper end of said second segment is contiguous with and rigidly attached to said lower surface of said second protrusion, said magazine release button interference pin spring is a helical spring or coil spring with a length, a diameter, a longitudinal axis, an upper end, and a lower end, said diameter of said magazine release button interference pin spring is larger than said diameter of said first segment, said magazine release button interference pin retaining pin is a solid rigid cylindrical member with a length, a diameter, a longitudinal axis, a left end, a right end, an upper surface, and a lower surface, and said diameter of said magazine release button interference pin retaining pin is less than said length of said second segment.

* * * * *